US007255406B1

(12) United States Patent
Huck et al.

(10) Patent No.: US 7,255,406 B1
(45) Date of Patent: Aug. 14, 2007

(54) METHOD FOR MANUFACTURING TRACK FOR AUGER BORING MACHINE

(75) Inventors: Christopher A. Huck, Wadsworth, OH (US); David L. Kauffman, Shreve, OH (US)

(73) Assignee: Astec Industries, Inc., Chattanooga, TN (US)

( * ) Notice: Subject to any disclaimer, the term of this patent is extended or adjusted under 35 U.S.C. 154(b) by 407 days.

(21) Appl. No.: 11/019,980

(22) Filed: Dec. 21, 2004

(51) Int. Cl.
*E21C 31/10* (2006.01)
*E21C 29/02* (2006.01)

(52) U.S. Cl. ..... 299/95; 299/58; 74/29

(58) Field of Classification Search ..... 299/95, 299/58; 74/29
See application file for complete search history.

(56) References Cited

U.S. PATENT DOCUMENTS

| | | | | |
|---|---|---|---|---|
| 2,196,260 | A | 4/1940 | Gatto | |
| 2,319,512 | A | 5/1943 | Parrish | |
| 2,338,351 | A * | 1/1944 | Parrish | 173/187 |
| 2,835,472 | A | 5/1958 | Osborn | |
| 3,078,933 | A | 2/1963 | Orner | |
| 3,695,599 | A * | 10/1972 | Maxon et al. | 266/58 |
| 3,870,279 | A | 3/1975 | Century | |
| 4,025,120 | A | 5/1977 | Balinor et al. | |
| 4,097,716 | A * | 6/1978 | Reichelt et al. | 219/137 R |
| 4,184,715 | A | 1/1980 | Lanfermann | |
| 6,332,502 | B1 | 12/2001 | Mills et al. | |
| 6,374,929 | B1 | 4/2002 | Barbera | |
| 6,533,046 | B2 | 3/2003 | Mills et al. | |
| 7,134,513 | B1 * | 11/2006 | Randall et al. | 175/122 |
| 2002/0079137 | A1 | 6/2002 | Mills et al. | |
| 2002/0112891 | A1 | 8/2002 | Barbera | |

* cited by examiner

*Primary Examiner*—John Kreck
(74) *Attorney, Agent, or Firm*—Chambliss, Bahner & Stophel, P.C.

(57) ABSTRACT

An auger boring machine having a drive mechanism for moving the machine along a desired direction of travel includes a drive motor having a shaft and a pinion mounted on the shaft. A method for manufacturing a track for such a boring machine includes providing a track base rail adapted to support the auger boring machine and arranging the base rail along the desired direction of travel of the boring machine. The method also includes cutting a gear rack which includes a plurality of gear teeth along one side that are adapted to mesh with the pinion of the drive mechanism, and a flexibility notch on the side opposite the gear teeth. The gear rack is attached to the base rail with the gear teeth oriented so as to engage with the pinion of the drive mechanism.

13 Claims, 9 Drawing Sheets

METHOD FOR MANUFACTURING TRACK FOR AUGER BORING MACHINE

FIELD OF THE INVENTION

The invention relates generally to auger-type boring machines which include a sled that moves along a track. More particularly, the invention relates to a track for an auger boring machine that includes a drive mechanism which includes a drive motor having a shaft and a pinion mounted on the shaft.

BACKGROUND OF THE INVENTION

Subterranean boring machines are used to install a casing or pipe in the ground without excavating a trench for the casing. The boring machine generally includes a sled that rolls along a track comprised of a pair of track rails, which track is generally placed in a pit that is dug to a depth to permit the sled to be placed in alignment and on grade with the desired underground installation. A section of casing is located on the front end of the sled with a cutting head or auger mounted thereon. The sled carries a rotation mechanism for rotating the auger and a translation mechanism for driving the sled along the track so as to drive the auger section into the ground as it rotates, along with a surrounding casing section. Generally, the translation mechanism includes a pair of dogs which engage drive holes in the track rails and a pair of hydraulic actuators. In operation, the dogs engage a set of drive holes and the hydraulic actuators are extended to drive the sled in the boring direction. When the actuators have extended to their maximum length, the dogs are disengaged from the track rails and the actuators are fully retracted. Then the dogs engage a second set of drive holes and the actuators are extended to drive the sled another step in the boring direction. This incremental driving process is continued as the sled travels to the terminal end of the track. Once the sled has reached the terminal end of the track and has driven an auger section and a casing section into the ground by the distance of its travel, the casing and auger sections are released from the sled and the sled is retracted from the terminal end back to the initial end. Sections of casing and auger are then added to the ends of the casing and auger sections that protrude from the bore, and the incremental driving process is repeated until enough sections of the casing have been driven into the ground to comprise the desired overall length of the subterranean installation. Once all of the sections of casing are installed, the auger sections must be removed from the casing sections and, unless the casings are installed merely for drainage, an underground utility product must then be placed within the casings.

In most conventional auger boring machines, the translation mechanism that is employed to move the sled in the forward direction also moves the sled in the reverse direction on the track, employing the same hydraulic actuators that are used to drive the sled forward (in the boring direction). In this conventional reverse translation process, the actuators are repeatedly extended and retracted in conjunction with the incremental engagement and disengagement of the dogs in the drive holes. That is, the dogs are retracted from a pair of drive holes and the actuators are extended to drive the dogs in the rearward direction until they are aligned with the previous set of drive holes. The dogs are then engaged with the drive holes and the actuators retracted to move the sled in the rearward direction. This repeated extension and retraction process is continued until the sled reaches the initial end of the track. Since this process for moving the sled in the reverse direction on the track employs the same hydraulic actuators and dogs as are used in moving the sled in the boring direction, movement of the sled in the reverse direction, whether to move the sled back to receive a section of casing and auger, to withdraw an auger section or for any other purpose, will generally take as much time as it takes to move it in the boring direction.

Another known method for moving the sled in the reverse direction on the track may be employed when the sled is equipped with a power winch. In the practice of this method, a wire rope is extended from the winch and attached to a fixture at the initial end of the track, and the winch is used to pull the sled back from the terminal end. This method may be faster than the incremental method described above; however, it is generally only suitable for moving the sled back to receive a section of casing and auger for further boring.

It is known to provide a supplemental drive system for a subterranean boring machine, which supplemental drive system may be used to move the sled in the reverse direction more quickly than the conventional drive system. Thus, for example, U.S. Pat. No. 6,374,929 and No. 6,715,565 of Barbera both describe a supplemental drive system which includes a primary and a secondary drive wheel on each side of the sled. A drive sprocket is attached to the primary drive wheel and the primary drive wheel is mounted on the shaft of a hydraulic motor. An idler sprocket is mounted on the secondary drive wheel, and a chain connects the drive sprocket and the idler sprocket. Each supplemental drive system is mounted so that the drive wheels are biased against the track by a pair of springs to cause the primary and secondary drive wheels to frictionally engage the track. The drive motor drives the primary drive wheel, which in turn, drives the secondary drive wheel so as to move the sled along the track when the sled is not driving an auger section and surrounding casing section into the ground. The Barbera system may be subject to slippage if oil or water is introduced on the track or if its springs do not provide sufficient biasing force to ensure that the wheels frictionally engage the track. Furthermore, it is believed that the Barbera system for frictional engagement does not have the power to withdraw auger sections from the installed casings.

U.S. patent application Ser. No. 10/886,808 describes an auger boring machine for use in connection with a track having a gear rack. The preferred embodiment of this auger boring machine includes a sled that is mounted on the track and adapted to be moved by a drive mechanism which includes a drive motor having a shaft and a pinion mounted on the shaft which is adapted to engage with the gear rack on the track to drive the sled along the track. In the preferred embodiment of this auger boring machine, rack-and-pinion drive mechanism is a supplemental drive system employed to move sled in the rearward direction, and the sled is also provided with a conventional translation mechanism that drives the sled along the track while the cutting head is boring the bore for the casing. The preferred embodiment of this auger boring machine also includes a rack-and-pinion drive mechanism for each side of the sled (and for each rail of the track). In various embodiments of the invention, the drive motor may be arranged to rotate the pinion about a horizontal axis or about a vertical axis.

When the driving mechanism for the auger boring machine that is described in U.S. application Ser. No. 10/886,808 was developed, the gear rack portion of each track section was cut from a thick steel plate using a cutting torch. In such method, a complex gear shape is cut on one side of the gear rack portion and a straight cut is made on the other side of the gear rack portion. Applicants have found that this method creates warping or "bowing" along the length of the gear rack portion of the track because heat stresses are concentrated on the "gear" side of the gear rack portion due to the considerable length of the cut and the time required to make it, as compared with the straight cut on the opposite side. The ends of the gear rack portion tend to remain in the plane of the plate from which it is cut and to bow or curve in a direction towards which the gear teeth point. Because the gear rack portion must be sufficiently thick and strong to support the auger boring machine during driving operation, it has little inherent flexibility. However, the gear rack must be straight in order for the drive mechanism of the auger boring machine to function properly. Consequently, if such a gear rack portion is warped or bowed along its length, it can only be straightened with much difficulty, if at all. Applicants have found that straightening such a gear rack typically requires several heat treatments and considerable time. It would be desirable, therefore, if a method could be developed that would mitigate and compensate for the harmful bowing or warping effect which has accompanied this method of manufacturing a track for the auger boring machine by cutting the gear rack portion from a steel plate using a torch or other heat source.

ADVANTAGES OF THE INVENTION

Among the advantages of the invention is that it provides a method for manufacturing a track for an auger boring machine having a rack-and-pinion type drive mechanism, which method imparts additional flexibility to the gear rack portion of the track. Another advantage of the invention is that it provides such a method that mitigates the adverse heating effects which resulted from a prior method. Still another advantage of the invention is that it provides such a method that requires less time and labor to perform than a prior method. A preferred embodiment of the invention also provides a simple means to insure that opposing gear racks adapted for use in connection with a dual rack-and-pinion drive system are properly spaced for fixation to the base rails of the track.

Additional advantages of the invention will become apparent from an examination of the drawings and the ensuing description.

EXPLANATION OF TECHNICAL TERMS

As used herein, the term "pinion" refers to a gear-toothed wheel, sprocket, worm gear or similar device that is adapted to mesh with a gear rack for converting rotary motion into linear motion.

As used herein, the terms "gear rack" and "rack" refer to a straight, toothed bar or similar device that is adapted to mesh with a pinion for converting rotary motion into linear motion. The term gear rack may also refer to a portion or section of a gear rack that comprises a part of a track for an auger boring machine.

As used herein, the term "forward" and similar terms, when used in connection with a description of the relative motion of a sled of an auger boring machine along a track, refers to the direction towards the bore.

As used herein, the terms "rearward", "backward" and similar terms, when used in connection with a description of the relative motion of a sled of an auger boring machine along a track, refers to the direction away from the bore.

As used herein, the term "track" refers to a structure or portion of a structure that supports an auger boring machine and along which the auger boring machine moves in the forward and rearward directions.

SUMMARY OF THE INVENTION

The invention comprises a method for manufacturing a track for an auger boring machine having a drive mechanism for moving the machine along a desired direction of travel, which drive mechanism includes a drive motor having a shaft and a pinion mounted on the shaft. The method includes providing a track base rail adapted to support the auger boring machine and arranging the base rail along the desired direction of travel of the boring machine. The method also includes cutting a gear rack which includes a plurality of gear teeth along one side that are adapted to mesh with the pinion of the drive mechanism, and a flexibility notch on the side opposite the gear teeth. The gear rack attached to the base rail with the gear teeth oriented so as to engage with the pinion of the drive mechanism. In a preferred embodiment of the invention, a method for manufacturing a track for an auger boring machine having a dual rack-and-pinion drive mechanism includes providing a spacing fixture that is adapted to simulate the distance between the pinion of a first drive motor and the pinion of a second drive motor on the opposite side of the boring machine. This spacing fixture includes a first fixture section having a plurality of gear teeth along one side that are adapted to mesh with the gear teeth of the first gear rack, a second fixture section having a plurality of gear teeth along one side that are adapted to mesh with the gear teeth of the second gear rack, and a joining member that is attached to the first fixture section and the second fixture section. The joining member is adapted to space the fixture sections so as to simulate the distance between the pinion of the first drive motor and the pinion of the second drive motor with the gear teeth of the first fixture section in mesh with the gear teeth of the first gear rack and the gear teeth of the second fixture section in mesh with the gear teeth of the second gear rack.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
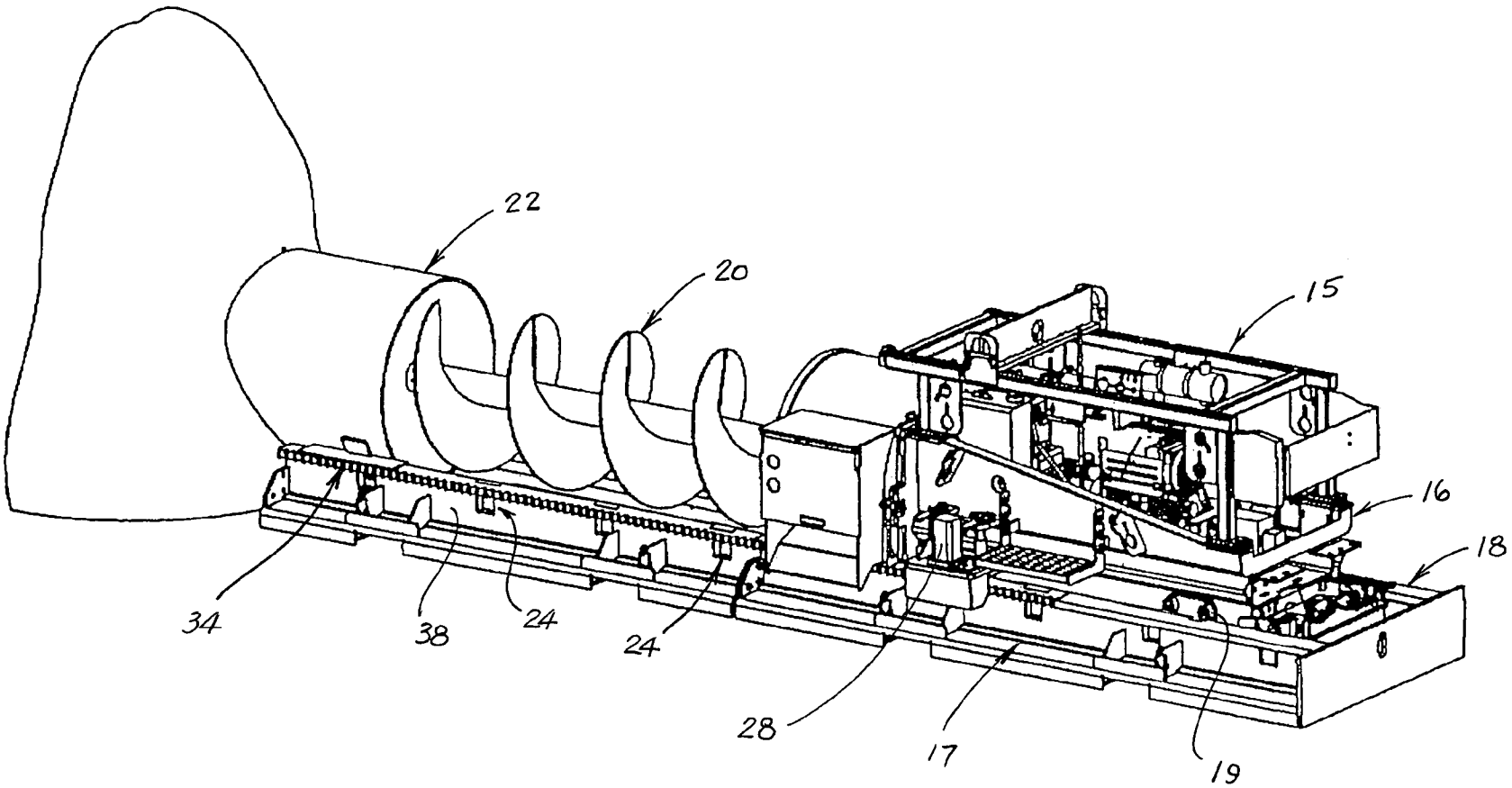
FIG. 1 is a perspective view of an auger boring machine having a preferred drive mechanism that is adapted for use with a track made according to the preferred method.
Figure 2:
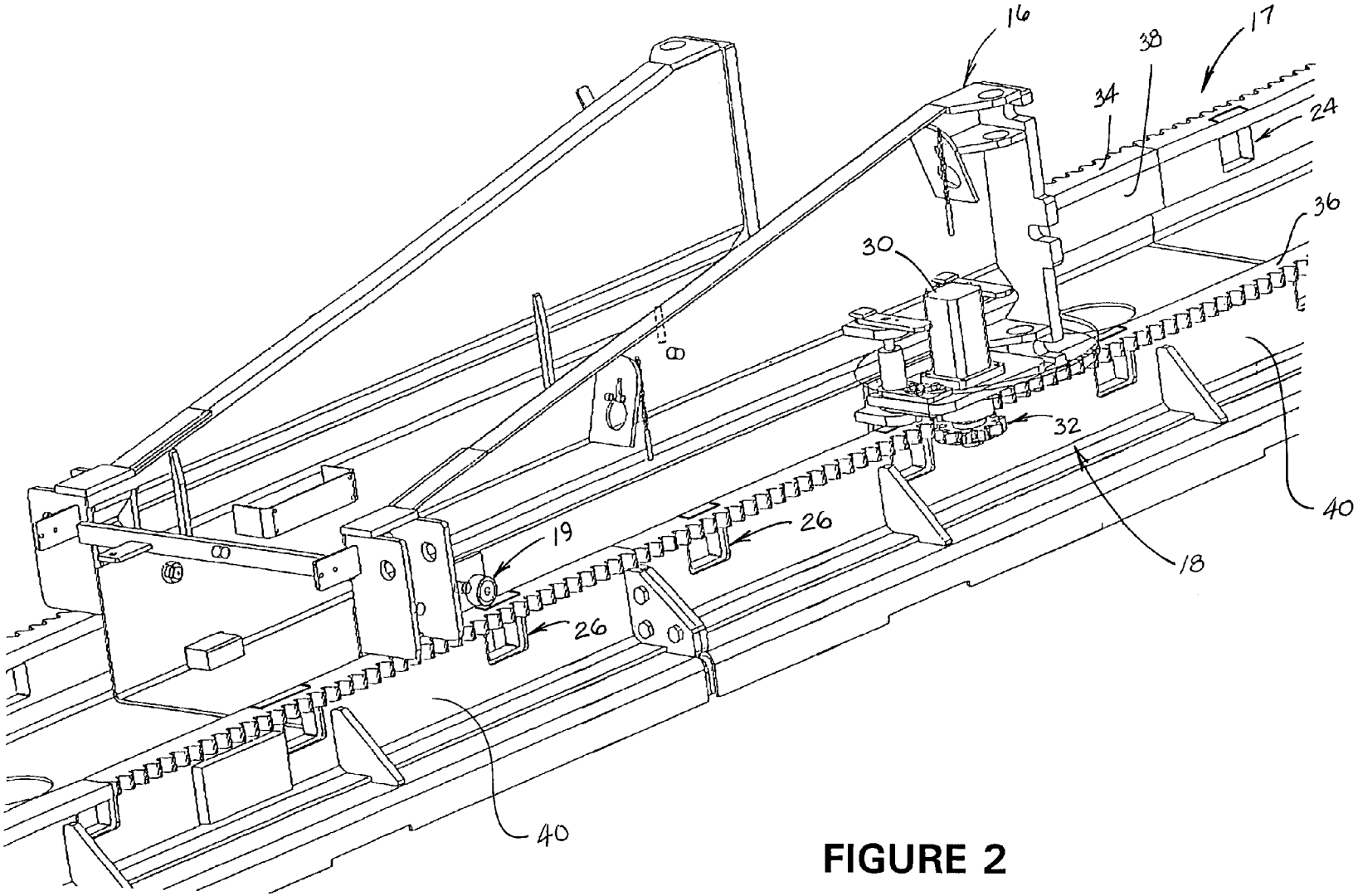
FIG. 2 is a rear perspective view of a portion of the sled of the auger boring machine of FIG. 1, showing the sled mounted on a track made according to the preferred method and showing a preferred embodiment of the track.

Referring now to the drawings, FIG. 1 illustrates an auger boring machine mounted on a track made according to a preferred embodiment of the invention. As shown therein, subterranean boring machine 15 includes a sled 16 (also shown from a reverse angle in FIG. 2) that rolls along a track comprised of track rails 17 and 18 by means of a plurality of rollers such as rollers 19. The sled includes a conventional cutting or boring mechanism that rotates a cutting head or auger 20 in front of a section of casing 22 that is being installed. Sled 16 also includes a conventional translation mechanism (not shown) that drives the sled along the track while the cutting head is boring the bore for the casing. This translation mechanism includes hydraulic actuators (not shown) which move a dog assembly (also not shown) that includes a pair of push dogs which are adapted to engage drive holes 24 in track rail 17 and corresponding drive holes 26 (shown in FIG. 2) in track rail 18. In operation, the dogs engage a set of drive holes and the hydraulic actuators are extended to drive the sled in the boring direction. When the actuators have extended to their maximum length, the dogs are disengaged from the track and the actuators are fully retracted. Then the dogs engage a second set of drive holes and the actuators are extended to drive the sled another step in the boring direction.

Auger boring machine 15 also includes a drive system having a pair of motors that are mounted on opposite sides of sled 16. Although the drive motors may be electric motors, it is preferred that the motors be hydraulically operated, such as hydraulic motors 28 (shown in FIG. 1) and 30 (shown in FIG. 2). In this embodiment of the auger boring machine, the motors are located near the front of the sled and arranged so that their shafts are oriented vertically. A pair of pinions on the motor shafts (including pinion 32 on the shaft of motor 30) engage a pair of racks, including rack 34 and rack 36 that are mounted on the top of base rails 38 (of track rail 17) and 40 (of track rail 18), respectively, of the track.

Figure 3:
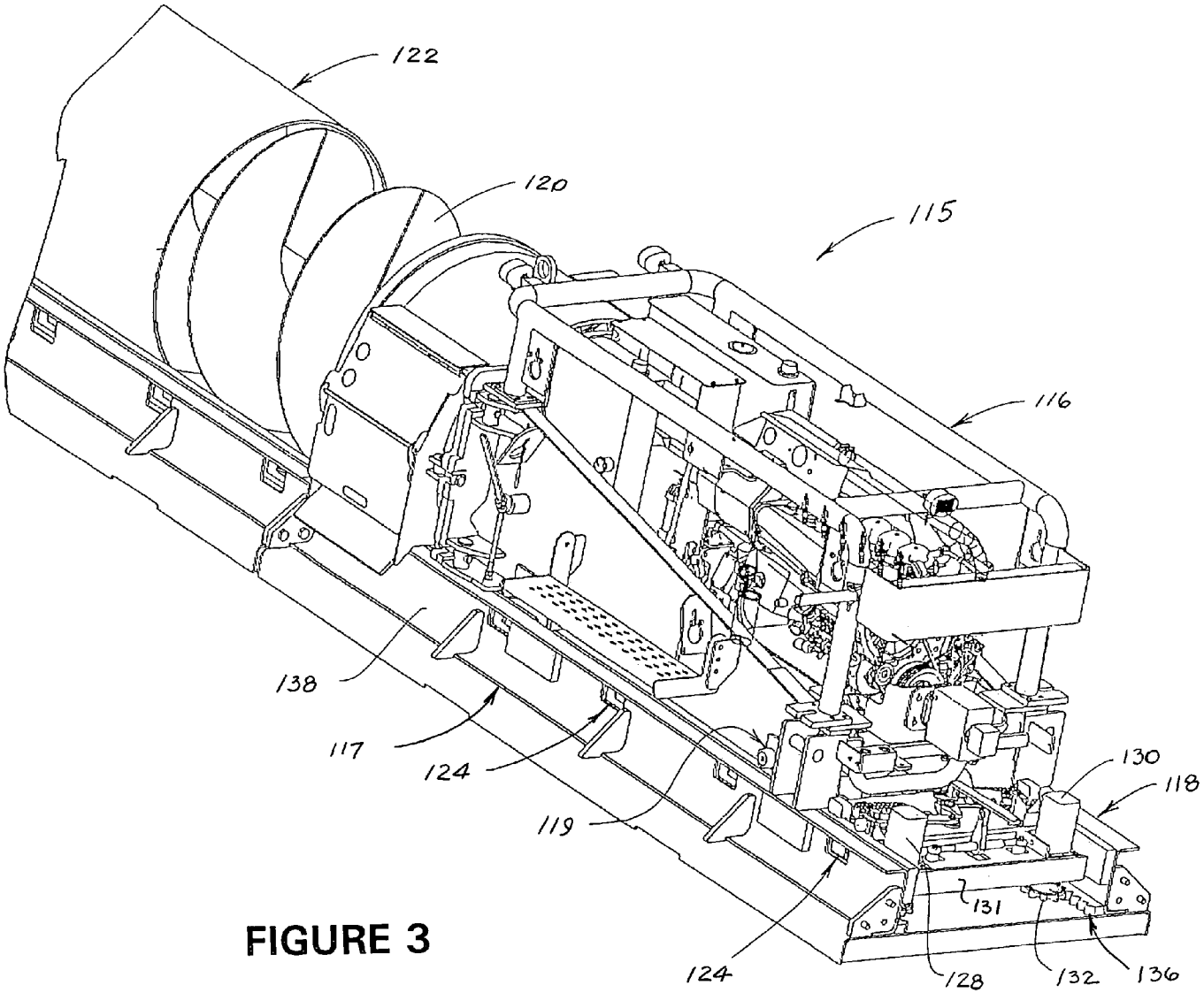
FIG. 3 is a perspective view of an auger boring machine having an alternative drive mechanism that is adapted for use with a track made according to the preferred method.
Figure 4:
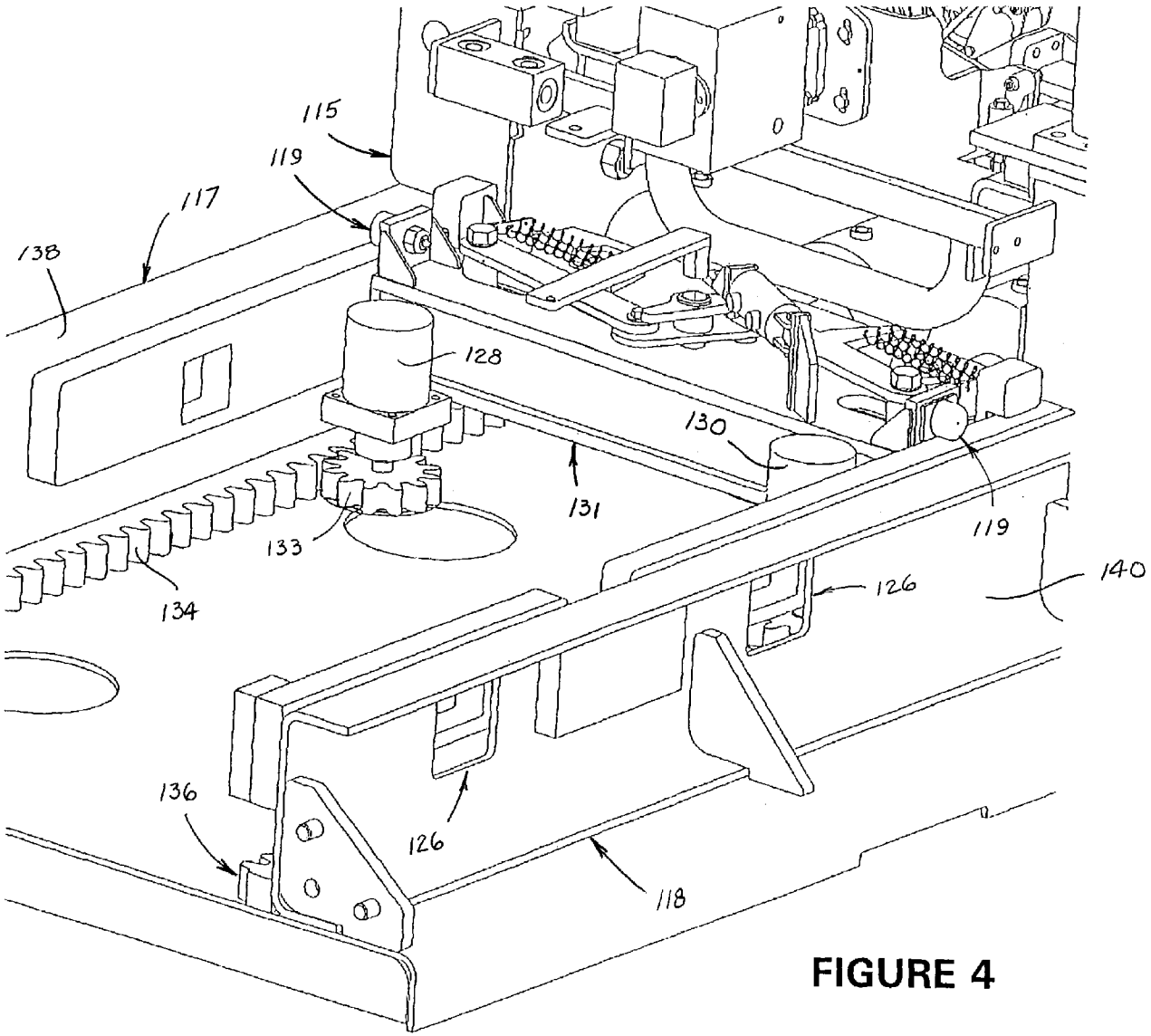
FIG. 4 is a perspective view of a portion of the sled of the auger boring machine of FIG. 3, showing an alternative embodiment of the track.

Another embodiment of a boring machine which may be used in connection with the invention is illustrated in FIGS. 3 and 4. As shown therein, boring machine 115 includes a sled 116 that rolls along a track comprised of track rails 117 and 118 by means of a plurality of rollers such as rollers 119. The sled includes a conventional cutting or boring mechanism that rotates a cutting head or auger 120 in front of a section of casing 122 that is being installed and a translation mechanism (not shown) that drives the sled along the track while the cutting head is boring the bore for the casing. This translation mechanism includes hydraulic actuators (not shown) which move a dog assembly (also not shown) that includes a pair of push dogs which are adapted to engage drive holes 124 in track rail 117 and corresponding drive holes 126 (shown in FIG. 4) in track rail 118. This conventional translation mechanism operates in the same way as the translation mechanism of boring machine 15. This embodiment of the auger boring machine includes a drive system having a pair of hydraulic motors 128 and 130 that are mounted on push bar 131 at the rear of sled 116. In this embodiment of the invention, the motors are arranged so that their shafts are oriented vertically, and pinion 132 (shown in FIG. 3) and pinion 133 (shown in FIG. 4) on the shafts of the motors engage a pair of racks 134 and 136 that are mounted on the inside of (and at the bottom of) base rails 138 (of track rail 117) and 140 (of track rail 118), respectively, of the track.

Figure 7:
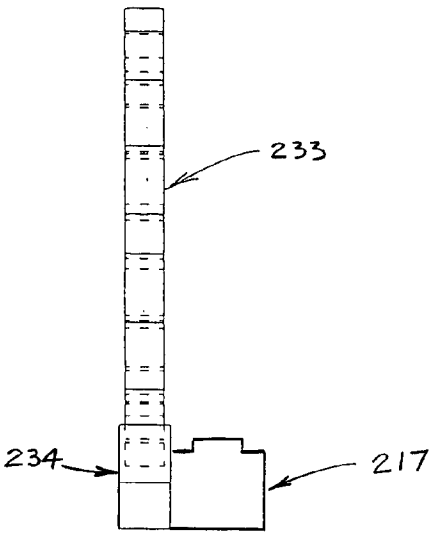
FIG. 7 is an end view of a pinion in engagement with a portion of the rack of the track of FIG. 5.
Figure 6:
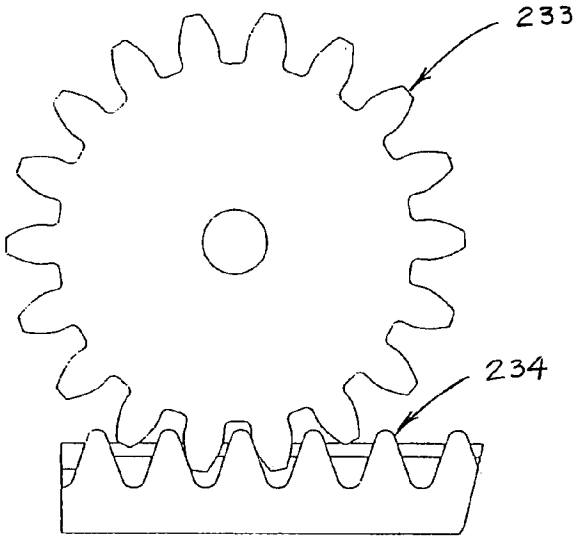
FIG. 6 is a side view of a pinion in engagement with a portion of the rack of the track of FIG. 5.
Figure 5:
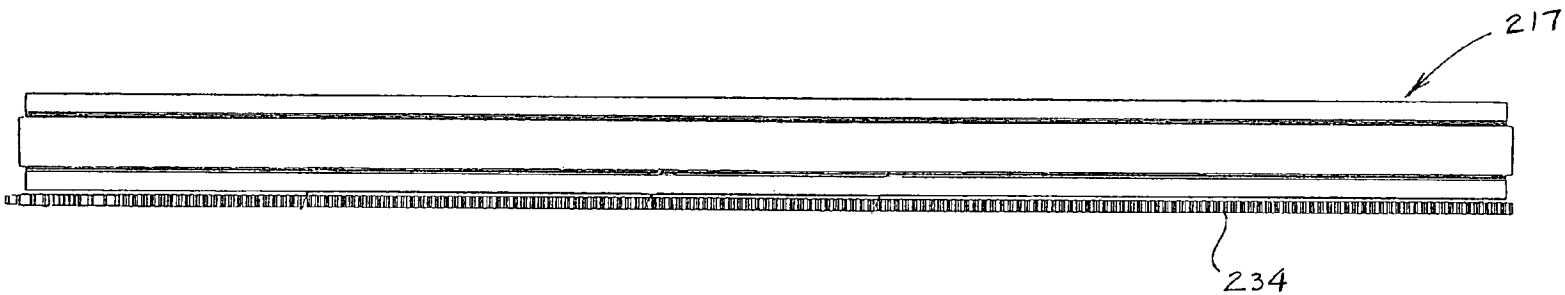
FIG. 5 is a top view of another embodiment of a track that is provided with a rack according to the invention.

An alternative type and arrangement of a rack-and-pinion drive system of an auger boring machine associated with the invention is illustrated in FIGS. 5-7. As shown therein, rack 234 is attached to track rail 217 and is arranged to engage with pinion 233 that is mounted so as to rotate about a horizontal axis.

Figure 8:
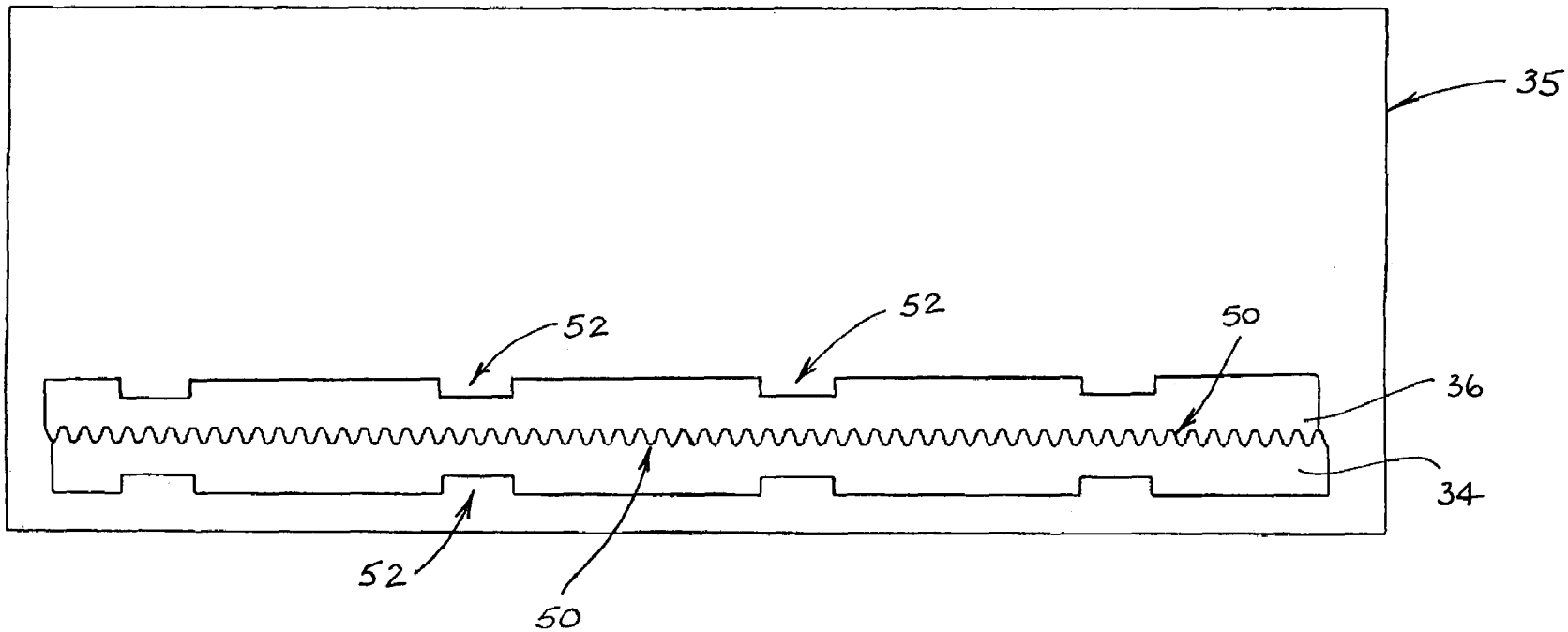
FIG. 8 is a top view of a blank from which a plurality of gear racks may be cut according to the preferred method.

FIG. 8 shows blank 35, preferably of ASTM A-36 steel, from which a plurality of gear racks, including gear racks 34 and 36 may be cut according to the preferred method. Preferably, the gear racks are cut using a conventional cutting torch (not shown) that is computer controlled, and preferably, the gear racks are cut so that a single pass of the cutting torch cuts the teeth for a pair of gear racks. As shown in the drawings, the gear rack is cut to include a plurality of gear teeth 50 along one side, which teeth are adapted to mesh with the pinion of the drive mechanism of the boring machine. The gear rack is also cut with a flexibility notch on the side opposite the gear teeth. Preferably, as shown in FIG. 8, a plurality of flexibility notches 52 that are spaced along the side opposite the gear teeth are cut in the gear rack. These flexibility notches provide flexibility to the gear rack so that any warping or bowing caused by heat stresses concentrated on the "gear" side of the gear rack may be overcome. The size, shape and number of flexibility notches may vary with the type and thickness of material from which the gear rack is cut, the length of the gear rack and the size and number of the gear teeth. Applicants have found that for a ten-foot gear rack cut from ASTM A-36 steel having a thickness of 1.5 inches, four spaced flexibility notches, each having a length of six inches and a depth of two inches, provide good results, permitting any bowing that results from cutting the teeth to be easily overcome by cold drawing the ends of the gear rack into line so that the gear rack can be attached to the track base rail in such a way that the gear teeth are oriented so as to engage with the pinion of the drive mechanism of the auger boring machine. Preferably, the gear rack is placed on the track base rail, clamped into position and then welded to the base rail.

Figure 9:
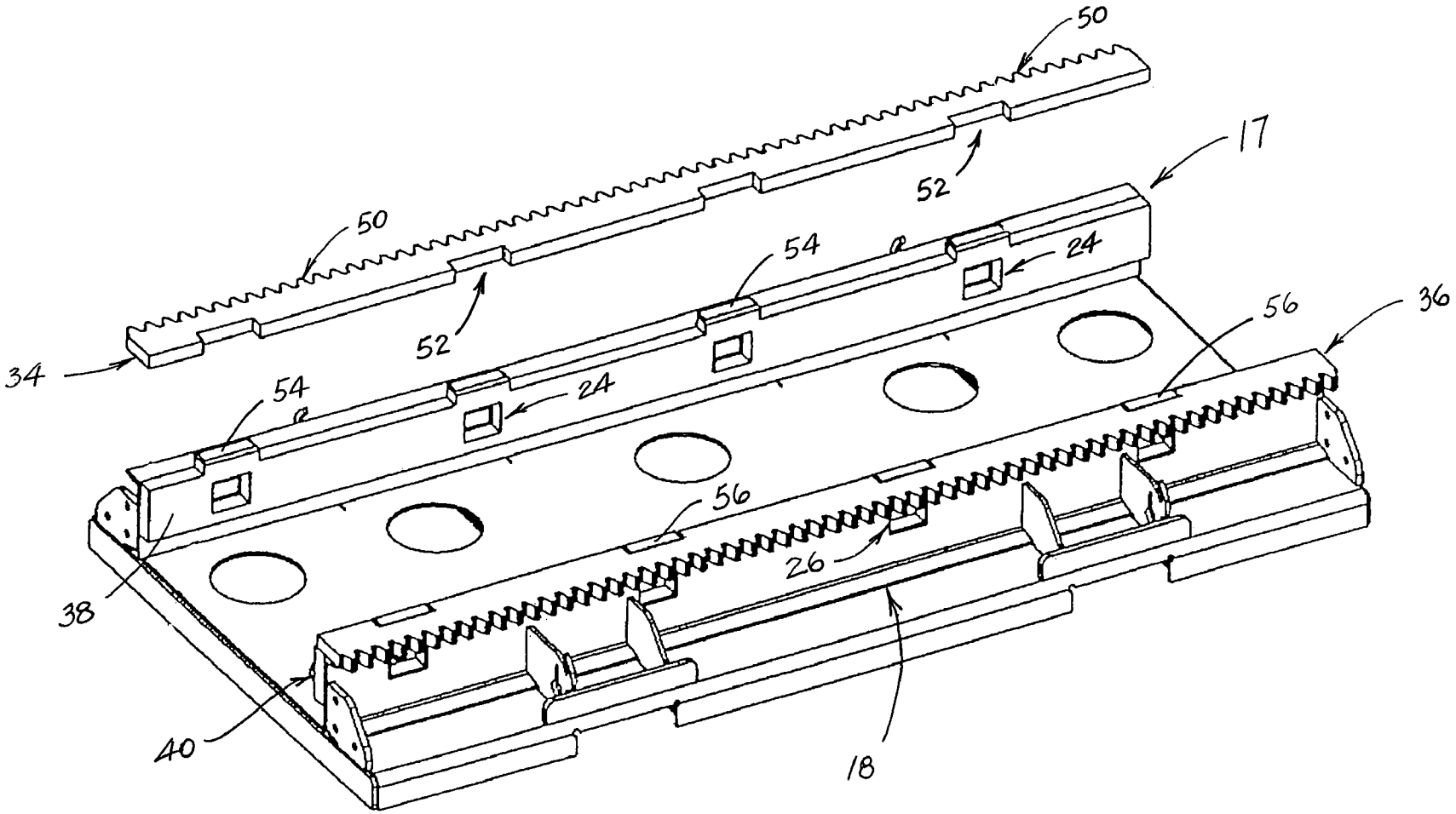
FIG. 9 is a perspective view, partially exploded, of a portion of a track of a preferred embodiment that is made according to the preferred method.

FIG. 9 illustrates a preferred embodiment of the invention in which the base rails are provided with a plurality of bosses spaced along the length thereof. As shown therein, track base rail 38 of track rail 17 is provided with a plurality of bosses 54 spaced along the length thereof, preferably aligned with drive holes 24. These bosses are adapted to engage with flexibility notches 52 of gear rack 34 to produce a flat surface on which the auger boring machine may roll.

Similarly, track base rail 40 of track rail 18 is provided with a plurality of bosses 56 spaced along the length thereof, preferably aligned with drive holes 26. Bosses 56 are adapted to engage with flexibility notches 52 of gear rack 36 to produce a flat surface on which the auger boring machine may roll.

Figure 10:
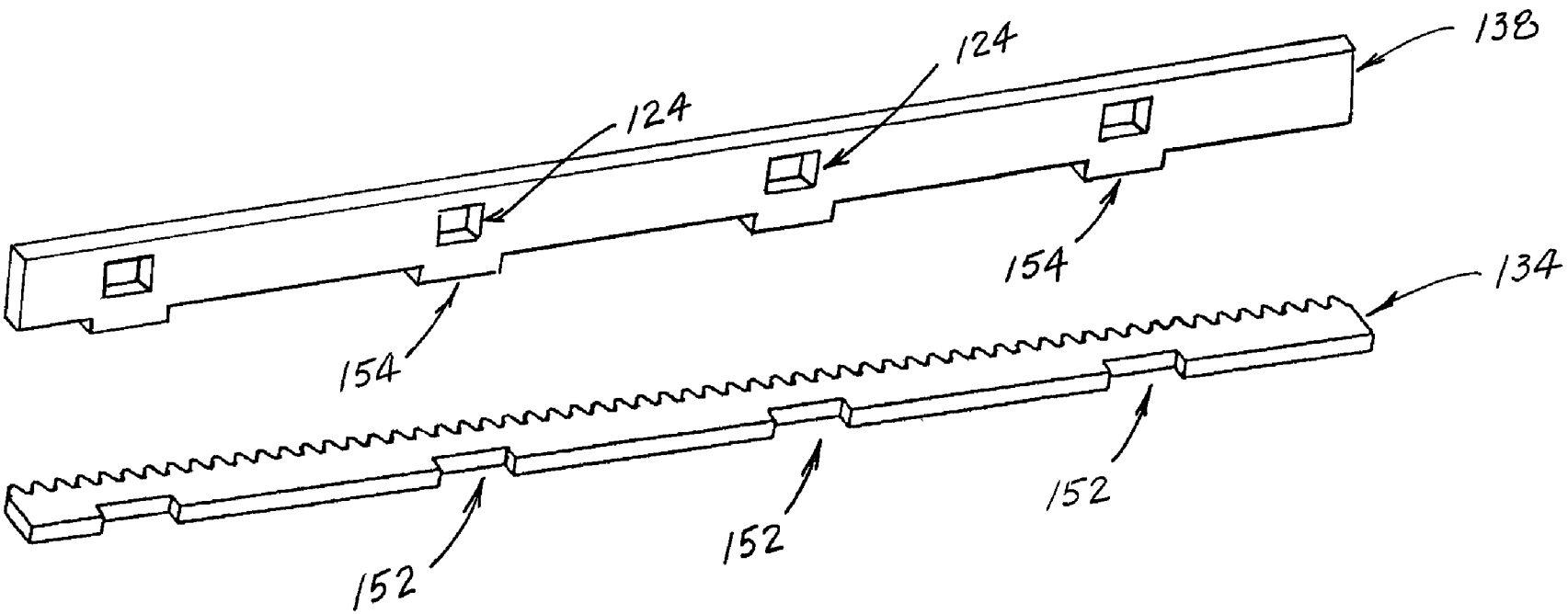
FIG. 10 is a perspective view of the arrangement of a track base rail and gear rack made according to the preferred method, showing an alternative embodiment of the track.

FIG. 10 illustrates the engagement of bosses on a base rail with flexibility notches on a gear rack when a track made according to the invention is configured according to the embodiment shown in FIGS. 3 and 4. As shown in FIG. 10, track base rail 138 of track rail 117 is provided with a plurality of bosses 154 spaced along the length thereof, preferably aligned with drive holes 124. These bosses are adapted to engage with flexibility notches 152 of gear rack 134.

Figure 12:
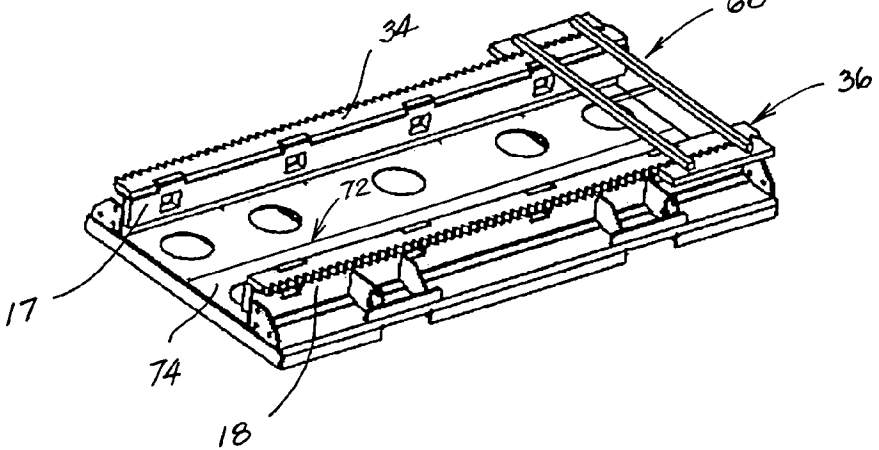
FIG. 12 is a perspective view of a portion of a track made according to the preferred method, showing the use of the spacing fixture that is provided in such method.
Figure 11:
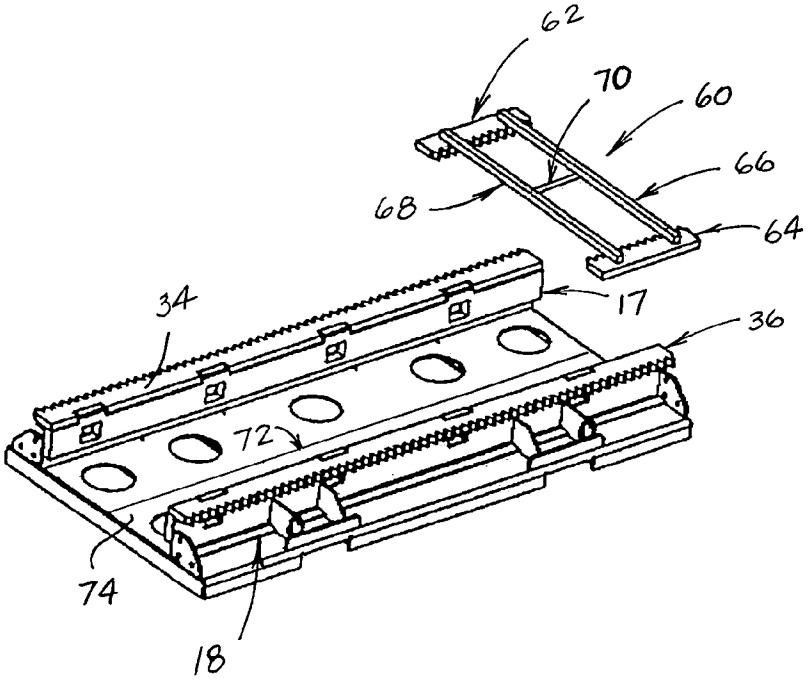
FIG. 11 is a perspective view of a portion of a track made according to the preferred method, showing the spacing fixture that is provided in such method.

A preferred embodiment of the invention includes the use of a spacing fixture in order to properly space the gear racks of a track section that is intended for use in connection with an auger boring machine having drive motors on opposite sides. As shown in FIGS. 11 and 12, spacing fixture 60 includes first fixture section 62 having a plurality of gear teeth along one side that are adapted to mesh with the gear teeth of the gear rack 34, and second fixture section 64 having a plurality of gear teeth along one side that are adapted to mesh with the gear teeth of gear rack 36. Spacing fixture also includes a joining member comprised of joining rods 66 and 68 that are attached to the first fixture section and the second fixture section. The joining member is adapted to space the fixture sections so as to simulate the distance between the pinion of the first drive motor and the pinion of the second drive motor with the gear teeth of the first fixture section in mesh with the gear teeth of gear rack 34 and the gear teeth of the second fixture section in mesh with the gear teeth of gear rack 36. The preferred spacing fixture is used when the gear racks have been placed on their associated base rails but not attached thereto. As shown in FIGS. 11 and 12, the spacing fixture is placed between gear rack 34 and gear rack 36 so that the gear teeth of first fixture section 62 are in mesh with the gear teeth of gear rack 34 and the gear teeth of second fixture section 64 are in mesh with the gear teeth of gear rack 36. Preferably, spacing fixture 60 is provided with centering marker 70 that is spaced equidistant between the first fixture section and the second fixture section in order to assist in properly spacing the gear racks on the track. Centerline 72 may be inscribed on track floor 74 to be aligned with centering marker 70 for this purpose.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations as would be understood by those having ordinary skill in the art to which the invention relates, and the same are intended to be comprehended within the meaning and range of equivalents of the appended claims.

What is claimed is:

1. A method for manufacturing a track for an auger boring machine having a drive mechanism for moving the machine along a desired direction of travel, which drive mechanism includes a drive motor having a shaft and a pinion mounted on the shaft, said method comprising:

(a) providing a track base rail adapted to support the auger boring machine;

(b) arranging said base rail along the desired direction of travel of the boring machine;

(c) cutting a gear rack which includes:

(1) a plurality of gear teeth along one side that are adapted to mesh with the pinion of the drive mechanism;

(2) a flexibility notch on the side opposite the gear teeth;

(d) attaching the gear rack to the base rail with the gear teeth oriented so as to engage with the pinion of the drive mechanism.

2. The method of claim 1 which includes the following step instead of step (c) of claim 1:

(c) cutting a gear rack which includes:

(1) a plurality of gear teeth along one side that are adapted to mesh with the pinion of the drive mechanism;

(2) a plurality of flexibility notches spaced along the side opposite the gear teeth.

3. The method of claim 1 which includes the following steps instead of step (d) of claim 1:

(d1) clamping the gear rack to the base rail with the gear teeth oriented so as to engage with the pinion of the drive mechanism;

(d2) welding the gear rack to the base rail.

4. The method of claim 1 which includes the following steps instead of the corresponding steps of claim 1:

(a) providing a track base rail adapted to support the auger boring machine, said base rail including a plurality of bosses spaced along the length thereof;

(c) cutting a gear rack which includes:

(1) a plurality of gear teeth along one side that are adapted to mesh with the pinion of the drive mechanism;

(2) a plurality of flexibility spaced notches along the side opposite the gear teeth, said flexibility notches being sized and arranged so as to engage with the bosses on the track base rail;

(d) attaching the gear rack to the base rail with the gear teeth oriented so as to engage with the pinion of the drive mechanism and with the flexibility notches in engagement with the bosses of the base rail.

5. The method of claim 4 which includes the following steps instead of step (d) of claim 4:

(d1) clamping the gear rack to the base rail with the gear teeth oriented so as to engage with the pinion of the drive mechanism and with the flexibility notches in engagement with the bosses of the base rail;

(d2) welding the gear rack to the base rail.

6. The method of claim 1 wherein the auger boring machine includes a translation mechanism for driving the sled along the track, said translation mechanism comprising at least one actuator having a base end and a rod end, said rod end being movable, with respect to the base end, between a retracted configuration and an extended configuration, wherein one of said ends is attached to the sled and the other end is attached to a dog assembly that is adapted to engage with and disengage from a series of spaced holes in the track so that the translation mechanism will move the sled in an incremental fashion along the track, said method including the following steps instead of the corresponding steps of claim 1:

(a) providing a track base rail adapted to support the auger boring machine, said base rail including a series of spaced holes which are adapted to be engaged with and disengaged from by the dog assembly of the boring machine, as said dog assembly moves the sled in an incremental fashion along the track;

(c) cutting a gear rack which includes:

(1) a plurality of gear teeth along one side that are adapted to mesh with the pinion of the drive mechanism;

(2) a plurality of spaced flexibility notches along the side opposite the gear teeth, said flexibility notches being spaced so as to correspond with the spacing of the holes in the track base rail;

(d) attaching the gear rack to the base rail with the gear teeth oriented so as to engage with the pinion of the drive mechanism, and with the flexibility notches aligned with the holes in the track base rail.

7. A method for manufacturing a track for an auger boring machine having a drive mechanism for moving the machine along a desired direction of travel, which drive mechanism includes a first drive motor located on one side of the machine and a second drive motor located on the opposite side of the machine, each of which drive motors has a shaft and a pinion mounted on the shaft, said method including the following steps:

(a) providing a first track base rail and a second track base rail which are adapted to support the auger boring machine;

(b) arranging said first and second base rails parallel to each other along the desired direction of travel of the boring machine;

(c) cutting a first gear rack and a second gear rack, each of which includes:

(1) a plurality of gear teeth along one side that are adapted to mesh with the pinion of the drive mechanism;

(2) a plurality of spaced flexibility notches along the side opposite the gear teeth;

(d) placing the first gear rack on the first base rail with the gear teeth oriented so as to engage with the pinion of the first drive motor;

(e) placing the second gear rack on the second base rail with the gear teeth oriented so as to engage with the pinion of the second drive motor;

(f) providing a spacing fixture comprising:

(1) a first fixture section having a plurality of gear teeth along one side that are adapted to mesh with the gear teeth of the first gear rack;

(2) a second fixture section having a plurality of gear teeth along one side that are adapted to mesh with the gear teeth of the second gear rack;

(3) a joining member that is attached to the first fixture section and the second fixture section, said joining member being adapted to space the fixture sections so as to simulate the distance between the pinion of the first drive motor and the pinion of the second drive motor with the gear teeth of the first fixture section in mesh with the gear teeth of the first gear rack and the gear teeth of the second fixture section in mesh with the gear teeth of the second gear rack;

(g) placing the spacing fixture between the first gear rack and the second gear rack so that the gear teeth of the first fixture section are in mesh with the gear teeth of the first gear rack and the gear teeth of the second fixture section are in mesh with the gear teeth of the second gear rack;

(h) attaching the first gear rack to the first track base rail;

(i) attaching the second gear rack to the second track base rail.

8. The method of claim 7:

(a) wherein the spacing fixture is provided with a centering marker that is spaced equidistant between the first fixture section and the second fixture section;

(b) which includes the following steps:

(1) locating the centerline of the track which is equidistant between the first track rail and the second track rail;

(2) aligning the centering marker of the spacing fixture along the centerline of the track prior to steps (h) and (i) of claim 7.

9. The method of claim 7:

which includes the following steps instead of step (a) of claim 7:

(a1) providing a first track base rail which is adapted to support the auger boring machine, said first track base rail including a plurality of bosses spaced along the length thereof;

(a2) providing a second track base rail which is adapted to support the auger boring machine, said second track base rail including a plurality of bosses spaced along the length thereof;

which includes the following steps instead of step (c) of claim 7:

(c1) cutting a first gear rack which includes:

(1) a plurality of gear teeth along one side that are adapted to mesh with the pinion of the drive mechanism;

(2) a plurality of spaced flexibility notches along the side opposite the gear teeth, said flexibility notches being sized and arranged so as to engage with the bosses on the first track base rail;

(c2) cutting a second gear rack which includes:

(1) a plurality of gear teeth along one side that are adapted to mesh with the pinion of the drive mechanism;

(2) a plurality of spaced flexibility notches along the side opposite the gear teeth, said flexibility notches being sized and arranged so as to engage with the bosses on the second track base rail;

which includes the following step instead of step (d) of claim 7:

(d) placing the first gear rack on the first base rail with the gear teeth oriented so as to engage with the pinion of the first drive motor and with the flexibility notches of the first gear rack in engagement with the bosses on the first base rail;

which includes the following step instead of step (e) of claim 7:

(e) placing the second gear rack on the second base rail with the gear teeth oriented so as to engage with the pinion of the second drive motor and with the flexibility notches of the second gear rack in engagement with the bosses on the second base rail.

10. The method of claim 9:

which includes the following steps instead of steps (a1) and (a2) of claim 9:

(a1) providing a first track base rail which is adapted to support the auger boring machine, said first track base rail including a plurality of drive holes spaced along the length thereof, and a plurality of bosses aligned with the drive holes;

(a2) providing a second track base rail which is adapted to support the auger boring machine, said second track base rail including a plurality of drive holes spaced along the length thereof, and a plurality of bosses aligned with the drive holes.

11. The method of claim 9:

which includes the following steps instead of step (d) of claim 9:

(d1) clamping the first gear rack to the first base rail with the gear teeth oriented so as to engage with the pinion of the drive mechanism and with the flexibility notches of the first gear rack in engagement with the bosses of the first base rail;

(d2) welding the first gear rack to the first base rail;

which includes the following steps instead of step (e) of claim 9:

(e1) clamping the second gear rack to the second base rail with the gear teeth oriented so as to engage with the pinion of the drive mechanism and with the flexibility notches of the second gear rack in engagement with the bosses of the second base rail;

(e2) welding the second gear rack to the second base rail.

12. A track for an auger boring machine having a drive mechanism for moving the machine along a desired direction of travel, which drive mechanism includes a drive motor having a shaft and a pinion mounted on the shaft, said track comprising:

(a) a base rail adapted to support the auger boring machine;

(b) a gear rack which is attached to the base rail, said gear rack including a plurality of gear teeth along one side that are adapted to mesh with the pinion of the drive mechanism, and a flexibility notch on the side opposite the gear teeth.

13. The track of claim 12:

(a) wherein the gear rack includes a plurality of flexibility notches spaced along the side opposite the gear teeth;

(b) which includes a series of spaced drive holes in the base rail, wherein said drive holes are:

(1) spaced in alignment with the flexibility notches of the gear rack;

(2) adapted to be engaged by a dog assembly of a translation mechanism of the auger boring machine for driving said machine along the track, said translation mechanism comprising at least one actuator having a base end and a rod end, said rod end being movable, with respect to the base end, between a retracted configuration and an extended configuration, wherein one of said ends of said actuator is attached to the auger boring machine and the other end is attached to the dog assembly.

* * * * *